United States Patent [19]

Rozmus

[11] Patent Number: 4,596,694

[45] Date of Patent: Jun. 24, 1986

[54] METHOD FOR HOT CONSOLIDATING MATERIALS

[75] Inventor: Walter J. Rozmus, Traverse City, Mich.

[73] Assignee: Kelsey-Hayes Company, Romulus, Mich.

[21] Appl. No.: 693,219

[22] Filed: Jan. 18, 1985

Related U.S. Application Data

[63] Continuation of Ser. No. 419,435, Sep. 20, 1982, abandoned.

[51] Int. Cl.[4] ..... B22F 3/14

[52] U.S. Cl. ..... 419/49; 264/64

[58] Field of Search ..... 419/49; 264/64

[56] References Cited

U.S. PATENT DOCUMENTS

| | | | |
|---|---|---|---|
| 3,356,496 | 12/1967 | Hailey | 419/48 X |
| 3,650,646 | 3/1972 | Kirkpatrick et al. | 425/78 |
| 3,656,946 | 4/1972 | Inque et al. | 419/49 |
| 4,061,453 | 12/1977 | DeSantis | 425/78 |
| 4,142,888 | 3/1979 | Rozmus | 419/48 X |
| 4,264,556 | 4/1981 | Kumar et al. | 425/78 X |
| 4,414,028 | 11/1983 | Inoue | 419/49 X |

FOREIGN PATENT DOCUMENTS

| | | | |
|---|---|---|---|
| 14975 | 9/1980 | European Pat. Off. | 419/49 |

OTHER PUBLICATIONS

Jones, W. D., *Fundamental Principles of Powder Metallurgy,* Edward Arnold Publishers, Ltd., London, pp. 339–341.

*Primary Examiner*—Edward A. Miller
*Assistant Examiner*—Matthew A. Thexton
*Attorney, Agent, or Firm*—Harold W. Milton, Jr.

[57] ABSTRACT

A quantity of material (10), which is at less than a predetermined density, is disposed within a sealed container (12) which is, in turn, disposed in a first thermal jacket (32) to retain the heat within the material (10) to be consolidated. The first thermal jacket (32) is placed within a second thermal jacket (34) which is, in turn, disposed in a cavity defined by two elastomeric components (22, 24) retained between a ram (16) and pot die (14) of a press whereby upon closure of the press, the ram (16) enters the cavity (26) of the pot die (14) to apply external pressure to the entire exterior of the elastomeric components (22, 24). A seal (36) of material harder than the elastomeric material (22, 24) is disposed within the cavity (26) of the pot die (14) for preventing the elastomeric medium (22, 24) from leaking between the sliding surfaces of the ram (16) and the pot die (14).

10 Claims, 4 Drawing Figures

METHOD FOR HOT CONSOLIDATING MATERIALS

This application is a continuation of Ser. No. 419,435, filed 9-20-82, now abandoned.

TECHNICAL FIELD

The subject invention is used for consolidating material of metallic and nonmetallic powder compositions and combinations thereof to form a predetermined densified compact. Consolidation is usually accomplished by evacuating a container and filling the container with a powder to be consolidated and thereafter hermetically sealing the container. Pressure is then applied to the filled and sealed container to subject the powder to pressure. Typically, heat is also applied to heat the powder to a compaction temperature. The combination of heat and pressure facilitates consolidation of the powder.

BACKGROUND ART

It is well-known to place a hermetically sealed container with the powder therein in an autoclave or hot isostatic press where it is subjected to heat and gas pressure.

Because of the expense and limitations of an autoclave or hot isostatic press, there have been significant developments made wherein the powder to be compacted is encapsulated in a substantially fully dense and incompressible container providing a pressure-transmitting medium which maintains its configurational integrity while being handled both at ambient temperatures and at the elevated compaction temperatures, yet becomes fluidic and capable of plastic flow when pressure is applied to the entire exterior surface thereof to hydrostatically compact the powder. Typically, the powder is hermetically encapsulated within the pressure-transmitting medium which is thereafter heated to a temperature sufficient for compaction and densification of the powder. After being sufficiently heated, the pressure-transmitting medium with the powder therein may be placed between two dies of a press which are rapidly closed to apply pressure to the entire exterior of the pressure-transmitting medium. The pressure-transmitting medium, at least immediately prior to a selected predetermined densification, must be fully dense and incompressible and capable of flow so that the pressure transmitted to the powder is hydrostatic and, therefore, from all directions, i.e., omnidirectional. After the material is densified to the desired degree, the pressure-transmitting medium defining the container must be removed from the compacted material and in so doing the integrity of the pressure-transmitting medium is lost whereby either the pressure-transmitting medium is no longer usable or must be completely recycled to fabricate a new container.

SUMMARY OF THE INVENTION AND ADVANTAGES

The subject invention is for consolidating material of metallic and nonmetallic compositions and combinations thereof to form a densified compact of a predetermined density wherein a quantity of such material which is less dense than the predetermined density is heated and disposed in a cavity in a pressure-transmitting medium to which external pressure is applied to the entire exterior of the medium to cause a predetermined densification of the material by hydrostatic pressure applied by the medium in response to the medium being substantially fully dense and incompressible and capable of elastic flow at least just prior to the predetermined densification. The invention is characterized by utilizing an elastomeric pressure-transmitting medium and encapsulating the material in a thermal insulating barrier means disposed within the cavity of the elastomeric medium to establish a thermal barrier between the material to be compacted and the elastomeric medium prior to applying pressure to the medium to limit heat transfer between the material and the elastomeric medium.

In order to effect compaction hydrostatically through a substantially fully dense and incompressible medium in a press, the press must provide sufficient force to cause plastic flow of the medium. Typically, the material to be compacted is placed within a pressure-transmitting medium which is, in turn, placed in a press where it is subjected to forces rendering it fluid and capable of transmitting forces hydrostatically to the material to be compacted and in so doing the pressure-transmitting medium changes shape. Additionally, the pressure-transmitting medium totally encapsulates the material being compacted and loses its integrity upon being removed from the compacted material. Because the pressure-transmitting medium changes shape during the compaction and has its integrity destroyed by being removed from the compacted material, it either cannot be reused or must undergo significant processing for reuse. An advantage of the subject invention is that the pressure-transmitting medium comprises an elastomeric medium which becomes fully dense and incompressible and capable of elastic flow just prior to the predetermined densification of the compact, yet is sufficiently elastic to return to its initial configuration for continued and repetitive reuse and compaction. This may be accomplished in accordance with the instant invention by utilizing a thermal insulating barrier means between the elastomeric medium and the heated material to be compacted so that the integrity of the elastomeric medium is not degraded by the heat and may be used repetitively.

BRIEF DESCRIPTION OF THE DRAWINGS

Other advantages of the present invention will be readily appreciated as the same becomes better understood by reference to the following detailed description when considered in connection with the accompanying drawings wherein.

DESCRIPTION OF THE INVENTION

Figure 1:
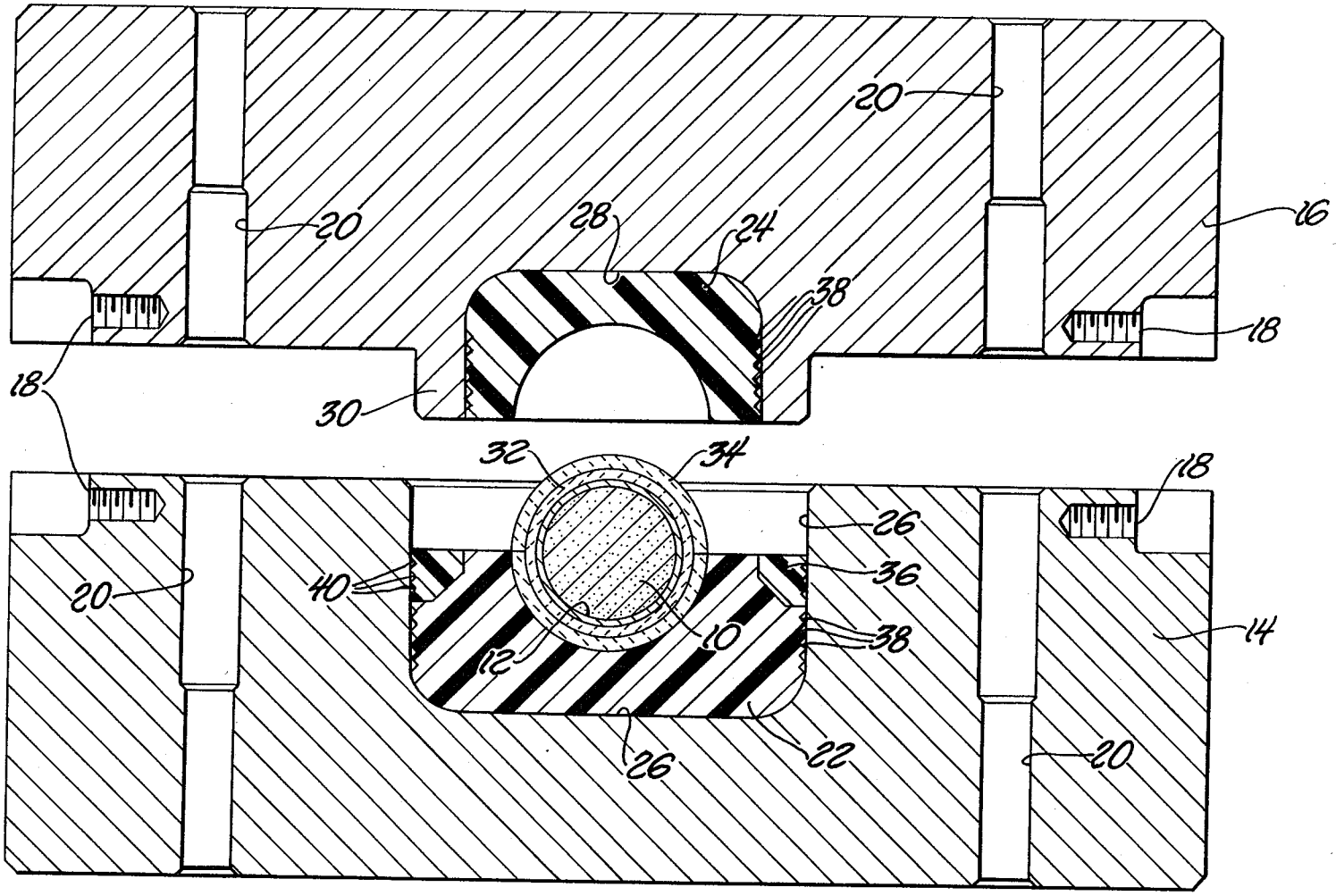
FIG. 1 is a cross-sectional view of an assembly utilized in accordance with the subject invention disposed in the open position.

The subject invention may be utilized for consolidating various metallic powders and nonmetallic powders, as well as combinations thereof, to form a densified compact. In accordance with the invention, the degree of density of the powder is increased to a predetermined or desired density which may be full density or densification or less than full density or densification.

The invention relates to a method for consolidating material of metallic and nonmetallic compositions and combinations thereof to form a densified compact of a predetermined density wherein a quantity of such material which is less dense than the predetermined final density is encapsulated in a pressure-transmitting medium to which external pressure is applied to the entire exterior of the medium to cause a predetermined densification of the encapsulated material by hydrostatic pressure applied by the medium in response to the medium being sustantially fully dense and incompressible and capable of elastic flow, i.e., fluidic, at least just prior to the predetermined densification. In other words, the medium transmits pressure hydrostatically like a liquid omnidirectionally about the material for compaction thereof.

As the invention is illustrated, a quantity of less than fully dense powder 10 fills and is encapsulated within a container 12. The container 12 is evacuated as by a vacuum through a tube (not shown) and then is filled with the powder 10 under vacuum through the tube. After filling, the tube is sealed to hermetically seal the container 12 with the powder 10 under a vacuum therein. The container 10 is a thin-walled and preferably of a sheet metal material. The container 12 may be filled and sealed in accordance with the teachings of U.S. Pat. No. 4,229,872 granted Oct. 28, 1980 and assigned to the assignee of the subject invention.

The container 12 is circular in cross section to define a cylinder and has a fill tube (not shown) extending from one end thereof. It will be understood, however, that the configuration of the container 12 will depend upon the desired configuration of the end part or compact.

As illustrated, an assembly for implementing the subject invention includes a pot die 14 and a ram 16 which include attachment points 18 for attaching alignment keys for aligning the pot die 14 and ram 16. The pot die 14 and the ram 16 also include bores 20 for receiving attaching bolts or pins to attach the pot die 14 and ram 16 to a press which may be one of any of a number of well-known types. The ram 16 and pit die 14 are aligned during the opening and closing of the press between the open position shown in FIG. 1 and the closed position shown in FIG. 2.

A pressure-transmitting medium, comprising first and second elastomeric components 22 and 24, defines a cavity for encapsulating the material to be consolidated. The pot die 14 is made of an incompressible material such as steel and includes a pot die cavity 26. In a similar fashion, the ram 16 is made of an incompressible material such as steel and includes a ram-cavity 28 therein. The ram 16 includes a raised flange or ridge 30 surrounding the ram-cavity 28. The pot-die cavity 26 has peripheral surfaces for receiving and sliding engagement with the exterior surfaces of the raised flange 30 of the ram 16. In other words, the interior surfaces of the cavity 26 in the pot die 14 are aligned with the exterior surfaces of the flange 30 of the ram 16 so that they are in close sliding engagement with one another as the pot die 14 and ram 16 are closed. The first component 22 of the elastomeric medium is retained in the pot-die cavity 26 as by being wedged therein or having small amounts of adhesive securing the elastomeric component to the cavity 26. In a similar fashion, the second elastomeric component 24 is retained in the ram-cavity 28. The first and second elastomeric components 22 and 24 define a cylindrical cavity for surrounding the material 10 for compaction thereof. The elastomeric components 22 and 24 may, in addition to natural rubber, consist of elastomers such as neoprene, polysiloxane elastomers, polyurethane, polysulfide rubber, polybutadiene, buna-S, etc. The elastomeric medium making up the components 22 and 24 is elastic in that it may be compressed and yet returns to its original configuration. However, after the elastomeric medium defining the components 22 and 24 is compressed to a certain degree, it becomes substantially incompressible, yet fluidic, i.e., capable of elastic flow, so that at the point of compaction and the desired densification of the powder 10, it hydrostatically applies pressure omnidirectionally about the container 12 to compact the powder 10 therein. The container 12 is of a material which is thin-walled and reduces in volume to compact the powder 10.

The powder 10 is heated to an elevated temperature for facilitating densification and compaction of the powder 10. In order to protect the elastomeric medium defining the components 22 and 24, a thermal insulating barrier means establishes a thermal barrier between the powder material 10 and the elastomeric medium 22 and 24 prior to applying pressure to the medium 22 and 24 by the closure of the pot die 14 and ram 16 to limit the heat transfer between the material 10 and the elastomeric medium 22 and 24. The thermal insulating barrier means includes a first thermal insulating jacket 32 completely surrounding the container 12 for limiting the heat loss from the material 10 and a second thermal insulating jacket 34 surrounding the first jacket 32 for protecting the elastomeric components 24 and 22 from heat emanating from the first jacket 32.

In accordance with the subject invention, the jackets 32 and 34 are made of a ceramic material having a very low thermal conductivity. In addition, the material of which the jackets 32 and 34 are made is fluidic or capable of flow at least just prior to the desired compaction of the powder 10 as pressure is applied thereabout hydrostatically through the elastomeric components 22 and 24. By analogy, the material of the jackets 32 and 34 may flow in the manner of quicksand just prior to compaction. In the preferred mode, the container 12 has the first jacket 32 cast thereabout in a mold so that the jacket 32 completely encapsulates the container 12 and is a monolithic and homogeneous material. The first jacket 32 with the container 12 and the material therein is heated to an elevated temperature sufficient for compaction. During this heating, the jacket 32 becomes heated. Thereafter, the jacket 32, with the container 12 and the material 10 therein, is placed within the second jacket 34 within the cavity defined by the elastomeric components 22 and 24. The second jacket 34 is made of two complementary sections which mate together to completely encapsulate and surround the first jacket 32. The second jacket 34 is also fluidic or capable of flow just prior to the desired densification of the powder 10. Once the heated material 10 within the container 12 which is, in turn, encapsulated in the first jacket 32 is placed within the second jacket 34 as illustrated in FIG. 1, the press closes to close the pot die 14 and ram 16 whereby the flange 30 of the ram 16 enters the cavity 26 of the pot die 14. It is important to note that the flange 30 enters the cavity 26 of the pot die 14 before the elastomeric components 22 and 24 contact one another and are compressed to create hydrostatic pressure as they become incompressible and fluidic for transmitting hydrostatic pressure omnidirectionally against the second jacket 34 which, in turn, transmits the hydrostatic pressure through the jacket 32 and the container 12 to compact and densify the powdered metal 10. To compensate for differences in coefficients of thermal expansion, either or both of the jackets 32 and 34 may be made of a ceramic having reinforcing fibers therein which allow some contraction or expansion of the basic materials making up the jackets 32 or 34. In other words, either one of the jackets 32 and 34 may have fibers dispersed therein for reinforcement. Further, the jackets 32 and 34 may be made of a crumbling material which may be crushed to become incompressible, but yet fluidic enough to transmit the pressure hydrostatically from the elastomeric components 22 and 24 to the container 12 and, thus, to the powdered metal 10.

It is important that the flange 30 of the ram 16 enter the cavity 26 of the pot die 14 prior to the elastomeric components 22 and 24 engaging one another to control the movement of the elastomeric components 22 and 24. Further to this end, a seal 35 of a harder material than the elastomeric medium defining the components 22 and 24 is disposed within and below the upper extremity of the cavity 26 of the pot die 14 so that after the flange 30 of the ram 16 enters the pot die 14 and applies pressure to the elastomeric components 22 and 24, the seal 36 is forced into sealing engagement with the interior surfaces of the cavity 26 in the pot die 14 at the juncture thereof with the exterior surface of the flange 30 of the ram 16 to prevent leakage of the elastomeric components 22 and 24 between the ram 16 and the pot die 14. The seal 36 is of a higher durometer than the elastomeric components 22 and 24 and, therefore, is less capable of plastic flow albeit the seal material 36 is capable of plastic flow.

Figure 2:
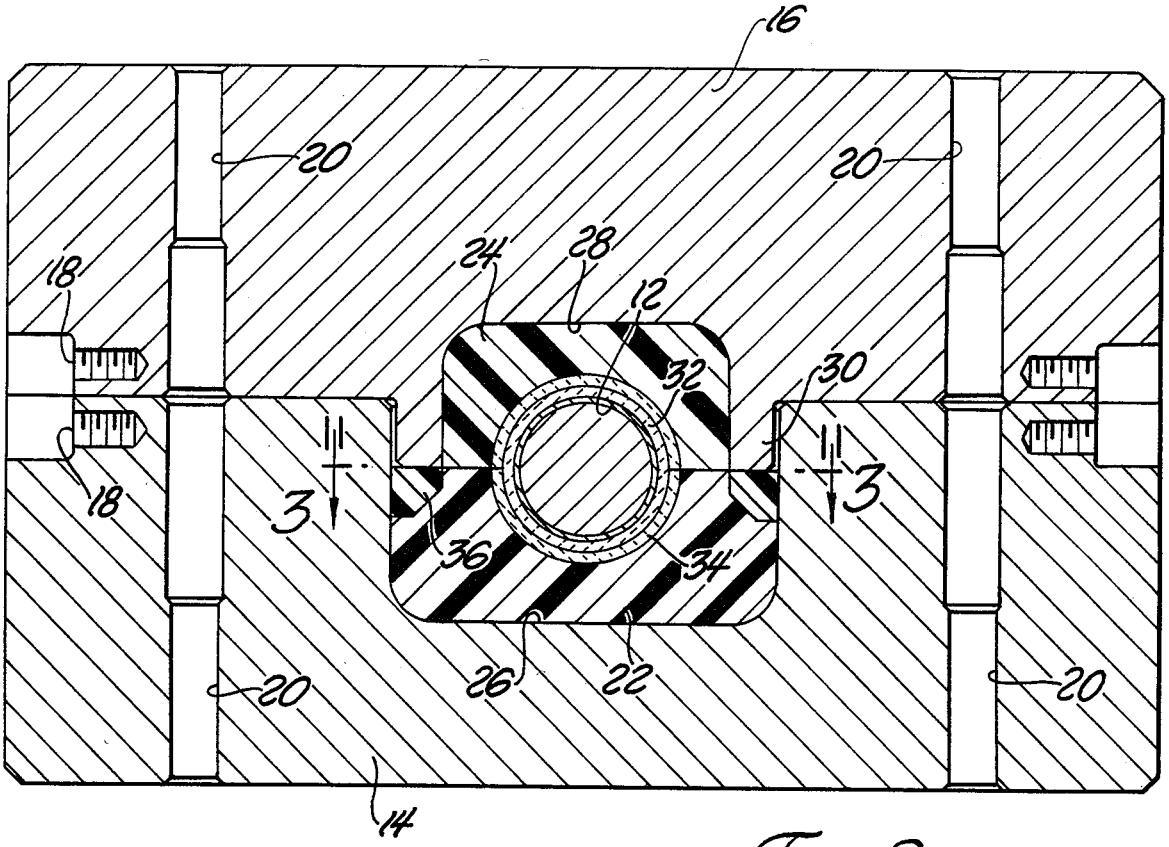
FIG. 2 is a cross-sectional view similar to FIG. 1 showing the assembly in a closed position.
Figure 3:
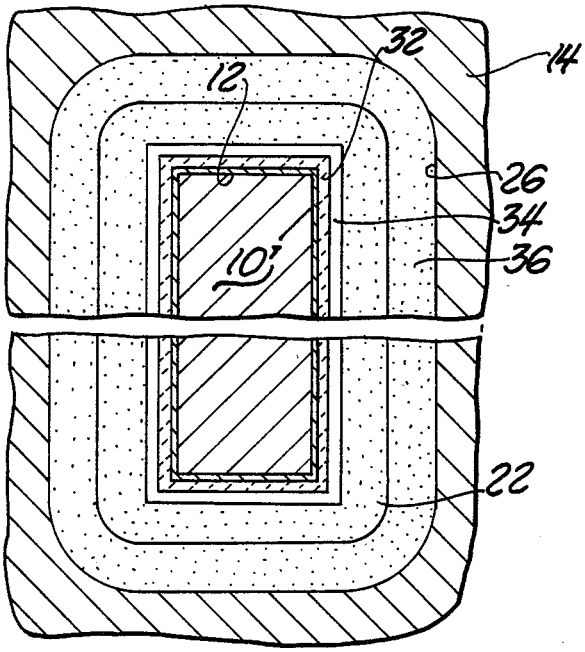
FIG. 3 is a fragmentary cross-sectional view taken along line 3—3 of FIG. 2.
Figure 4:
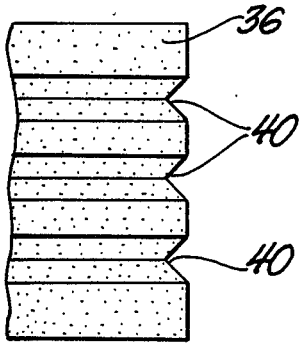
FIG. 4 is a fragmentary view of a portion of the exterior surface of a seal utilized in the assembly of the subject invention.

Once the flange 30 of the ram 16 enters the cavity 26 of the pot die 14, the elastomeric components 22 and 24 engage one another and begin to compress to a point at which they become incompressible and convey pressure hydrostatically in an omnidirectional fashion to compact the powdered metal 10. During the initial compression of the elastomeric components 22 and 24, they move or slide relative to the surfaces of the cavities in which they are disposed in the pot die 14 and ram 16, respectively. Accordingly, the components 22 and 24, as well as the seal 36, include a plurality of lubrication grooves 38 and 40, respectively, in the exterior surfaces thereof to facilitate movement relative to the adjacent supporting surface of the cavities in which they are disposed. Preferably, a lubricant is disposed within the grooves 38 and 40 to allow the material to compress and slide relative to the adjacent surfaces. As illustrated in FIG. 2, upon full compression of the components, the grooves are diminished in size so as to be imperceivable, yet the grooves exist to trap incompressible lubricant therein during full compression.

In accordance with the invention, the powdered metal 10 fills a thin-walled container 12 which is, in turn, encapsulated within a first thermal insulating jacket 32 as by having the jacket 32 cast thereabout, after which they are heated to an elevated temperature sufficient for compaction of the powder 10. Thereafter, a lower section of the second jacket 34 may be disposed within a cavity in the elastomeric component 22 of the pot die 14 and the first jacket 32 with the powder therein disposed within the lower section 34 of the outer jacket. The upper half or section of the second jacket 34 is then disposed over the heated inner or first jacket 32 and the ram and pot die are moved together to the position shown in FIG. 2 to densify and compact the powder into a densified compact 10'. The elastomeric medium defining the componets 22 and 24 may initially be compressible, but upon reaching a certain point of applied pressure becomes imcompressible so as to hydrostatically transmit pressure in an omnidirectional fashion entirely about the jackets 32 and 34 to the powder 10 to compact and densify the powder into the compact 10' of the desired densification. The pot die 14 and ram 16 may be opened to allow the elastomeric components 22 and 24 to return to their precompressed shape and to remove the compact 10' so that thereafter the container 10 and the jackets 32 and 34 may be removed to expose the compact 10'. Normally, the jackets 32 and 34 will be disposable and new jackets would be utilized on successive opening and closing of the pot die 14 and ram 16 for successively forming compacts 10'.

It will be appreciated that in many circumstances only one thermal insulating jacket may be utilized between the heated powdered material 10 and the elastomeric components 22 and 24. Additionally, the thicknesses of the thermal insulating barrier means may vary depending on the sizes, configurations, masses, etc. of the powder 10 to be compacted and densified.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

I claim:

1. A method for hot consolidating material (10) of metallic and nonmetallic compositions and combinations thereof to form a densified compact (10') of a predetermined density wherein a quantity of such material (10) which is less dense than the predetermined density is heated and disposed in a compaction cavity in a pressure-transmitting medium (22, 24) to which external pressure is applied to the entire exterior of the medium (22, 24) to cause a predetermined densification of the material by hydrostatic pressure applied by a medium (22, 24) in response to the medium being substantially fully dense and incompressible and capable of elastic flow at least just prior to the predetermined densification, said method including the steps of utilizing an elastomeric for the pressure-transmitting medium (22, 24) to define a first component (22) of elastomeric medium disposed within a pot die cavity (26) and a second component (24) of the elastomeric medium acted upon by a ram (16) movable into and out of the pot die cavity (26) in close sliding engagement therewith, positioning the first (22) and second (24) elastomeric components so that the ram (16) enters the cavity (26) of the pot die (14) prior to the first (22) and second (24) elastomeric components being compressed between said ram and pot die, heating the material (10) prior to placement in the compaction cavity defined by the first and second components (22, 24) of the elastomeric medium, encapsulating the material (10) in at least a portion of a formed and self-sustaining thermal insulating barrier means (32, 34) before placing the heated material into the compaction cavity, placing the thermal barrier means (32, 34) with the heated material encapsulated therein into the compaction cavity of the elastomeric medium, and applying pressure to the medium (22, 24) by moving the ram into the pot die and crumbling the barrier means (32, 34) into incompressibility while surrounding the material (10) to limit heat transfer between the material (10) and the elastomeric medium (22, 24), successively opening and closing the first and second components (22, 24) of elastomeric medium upon opening and closing of the ram (16) and pot die (14) in a press to successively form a plurality of densified compacts with a plurality of formed barrier means.

2. A method as set forth in claim 1 further characterized by encapsulating the material (10) in a thermal insulating barrier means and including a first thermal insulating jacket (32) for limiting heat loss from the material (10) and a second thermal insulating jacket (34) surrounding the first jacket (32) for protecting the elastomeric medium (22, 24) from heat from the first jacket (32).

3. A method as set forth in claim 2 further characterized by heating and encapsulating the material (10) in the first jacket (32) prior to disposing the first jacket (32) and material (10) within the second jacket (34) within the medium (22, 24).

4. A method as set forth in claim 3 further characterized by encapsulating the material (10) in a sealed container (12) and thereafter disposing the container (12) with the material (10) therein within the first jacket (32).

5. A method as set forth in claim 4 further characterized by casting the first jacket (32) about the container (12) so that the first jacket (32) is a monolithic material.

6. A method as set forth in claim 5 further characterized by disposing the first jacket (32) in the second jacket (34) of a plurality of sections mated together to surround the first jacket (32).

7. A method as set forth in any one of claims 1 through 6 further characterized by utilizing a thermal barrier means (32, 34) which is at least in part fluidic and capable of flow just prior to the predetermined densification.

8. A method as set forth in any one of claims 1 through 6 further characterized by utlizing a thermal barrier means (32, 34) which is at least in part reinforced with fibers dispersed therein.

9. A method as set forth in any one of claims 1 through 6 further characterized by providing a plurality of lubrication grooves (38) in the surface of at least one of the components (22, 24) of elastomeric medium to facilitate movement thereof relative to the adjacent supporting surface of the ram (16) or pot die (14).

10. A method as set forth in any one of claims 1 through 6 further characterized by disposing a seal (36) of a harder material than the elastomeric medium (22) within and below the extremity of the cavity (26) of the pot die (14) so that after the ram (16) enters the pod die (14) and applies pressure to the elastomeric medium the seal (36) is forced into sealing engagement with the cavity (26) of the pot die (14) at the juncture thereof with the ram (16) to prevent leakage of the elastomeric medium (22) between the ram (16) and pot die (14).

* * * * *